US009003757B2

(12) United States Patent
Mozsgai et al.

(10) Patent No.: US 9,003,757 B2
(45) Date of Patent: Apr. 14, 2015

(54) ROPE SYSTEMS AND METHODS FOR USE AS A ROUND SLING

(75) Inventors: Greg Zoltan Mozsgai, Ferndale, WA (US); Chiate Chou, Ferndale, WA (US); Dylan Bruce Dundas, Ferndale, WA (US)

(73) Assignee: Samson Rope Technologies, Ferndale, WA (US)

( * ) Notice: Subject to any disclaimer, the term of this patent is extended or adjusted under 35 U.S.C. 154(b) by 302 days.

(21) Appl. No.: 13/612,808

(22) Filed: Sep. 12, 2012

(65) Prior Publication Data

US 2014/0070557 A1 Mar. 13, 2014

(51) Int. Cl.
*B66C 1/12* (2006.01)

(52) U.S. Cl.
CPC ..... *B66C 1/12* (2013.01)

(58) Field of Classification Search
CPC ..... B66C 1/12
USPC ..... 57/21, 201; 294/74
See application file for complete search history.

(56) References Cited

U.S. PATENT DOCUMENTS

| | | | | |
|---|---|---|---|---|
| 1,168,802 | A * | 1/1916 | Harrison | 294/74 |
| 1,490,387 | A | 4/1924 | Hansen | |
| 1,695,480 | A | 10/1926 | Buoy | |
| 1,710,740 | A | 4/1929 | Ljungkull | |
| 1,850,767 | A | 12/1930 | Page | |
| 1,833,587 | A | 1/1931 | Page | |
| 1,908,686 | A | 5/1933 | Burke | |
| 1,931,808 | A | 10/1933 | Andersen | |
| 2,080,148 | A * | 5/1937 | Naysmith | 294/74 |
| 2,142,642 | A * | 1/1939 | Garris | 87/8 |
| 2,245,824 | A | 6/1941 | Roesch | |
| 2,299,568 | A | 10/1942 | Dickey | |
| 2,338,831 | A | 1/1944 | Whitcomb et al. | |
| 2,359,424 | A | 10/1944 | Joy | |
| 2,960,365 | A | 11/1960 | Meisen | |
| 3,035,476 | A | 5/1962 | Fogden | |
| 3,073,209 | A | 1/1963 | Benk et al. | |
| 3,181,907 | A * | 5/1965 | O'Donnell | 294/74 |
| 3,276,810 | A | 10/1966 | Antell | |
| 3,358,434 | A | 12/1967 | McCann | |

(Continued)

FOREIGN PATENT DOCUMENTS

| | | |
|---|---|---|
| CA | 2019499 | 2/2000 |
| CN | 200910203184.0 | 6/2009 |

(Continued)

OTHER PUBLICATIONS

Samson Rope Technologies, "Whoopie Sling Amsteel/Amsteel-Blue" Splicing Instructions, 2012, 2 pages.

(Continued)

*Primary Examiner* — Shaun R Hurley
(74) *Attorney, Agent, or Firm* — Michael R. Schacht; Schacht Law Office, Inc.

(57) ABSTRACT

A rope assembly that is adapted to extend between first and second attachment points comprises a line arranged to define a plurality of loops and at least one pair of organizers. The at least one pair of organizers is configured to engage the line such that line segments of the line between the at least one pair of organizers are maintained in a desired relationship with each other and such that the desired relationship facilitates transfer of loads through the rope assembly between the first and second attachment points.

23 Claims, 6 Drawing Sheets

(56) References Cited

U.S. PATENT DOCUMENTS 3,367,095 A 2/1968 Field, Jr.
3,371,476 A 3/1968 Costello et al.
3,383,849 A 5/1968 Stirling
3,411,400 A 11/1968 Morieras et al.
3,415,052 A 12/1968 Stanton
3,425,737 A 2/1969 Sutton
RE26,704 E 11/1969 Norton
3,481,134 A 12/1969 Whewell, Jr.
3,507,949 A 4/1970 Campbell
3,537,742 A 11/1970 Black
3,561,318 A 2/1971 Andriot, Jr.
3,583,749 A 6/1971 Hopkins
3,653,295 A 4/1972 Pintard
3,662,533 A 5/1972 Snellman et al.
3,718,945 A 3/1973 Brindejonc de Treglode
3,729,920 A 5/1973 Sayers et al.
3,762,865 A 10/1973 Weil
3,771,305 A 11/1973 Barnett
3,839,207 A 10/1974 Weil
3,854,767 A 12/1974 Burnett
3,904,458 A 9/1975 Wray
3,906,136 A 9/1975 Weil
3,915,618 A 10/1975 Feucht et al.
3,943,644 A 3/1976 Walz
3,957,923 A 5/1976 Burke
3,968,725 A 7/1976 Holzhauer
3,977,172 A 8/1976 Kerawalla
3,979,545 A 9/1976 Braus et al.
4,022,507 A 5/1977 Marino
4,031,121 A 6/1977 Brown
4,036,101 A 7/1977 Burnett
4,045,072 A * 8/1977 Brown ..... 294/74
4,050,230 A 9/1977 Senoo et al.
4,099,750 A 7/1978 McGrew
4,116,481 A 9/1978 Raue
4,155,394 A 5/1979 Shepherd et al.
4,159,618 A 7/1979 Sokaris
4,170,921 A 10/1979 Repass
4,173,113 A 11/1979 Snellman et al.
4,184,784 A 1/1980 Killian
4,195,113 A 3/1980 Brook
4,202,164 A 5/1980 Simpson et al.
4,210,089 A 7/1980 Lindahl
4,226,035 A 10/1980 Saito
4,228,641 A 10/1980 O'Neil
4,232,903 A 11/1980 Welling et al.
4,250,702 A 2/1981 Gundlach
4,257,221 A 3/1981 Feinberg
4,286,429 A 9/1981 Lin
4,312,260 A 1/1982 Morieras
4,321,854 A 3/1982 Foote et al.
4,329,794 A 5/1982 Rogers
4,350,380 A 9/1982 Williams
4,403,884 A 9/1983 Barnes
4,412,474 A 11/1983 Hara
4,421,352 A 12/1983 Raue et al.
4,464,812 A 8/1984 Crook, Jr. et al.
4,500,593 A 2/1985 Weber
4,509,233 A 4/1985 Shaw
4,534,163 A 8/1985 Schuerch
4,534,262 A 8/1985 Swenson
4,563,869 A 1/1986 Stanton
4,606,183 A 8/1986 Riggs
4,619,108 A 10/1986 Hotta
4,635,989 A 1/1987 Tremblay et al.
4,640,179 A 2/1987 Cameron
4,642,854 A 2/1987 Kelly et al.
4,677,818 A 7/1987 Honda et al.
4,757,719 A 7/1988 Franke
4,762,583 A 8/1988 Kaempen
4,779,411 A 10/1988 Kendall
4,784,918 A 11/1988 Klett et al.
4,850,629 A 7/1989 St. Germain
4,856,837 A 8/1989 Hammersla, Jr.
4,868,041 A 9/1989 Yamagishi et al.
4,887,422 A 12/1989 Klees et al.
4,947,917 A 8/1990 Noma et al.
4,958,485 A 9/1990 Montgomery et al.
4,974,488 A 12/1990 Spralja
5,060,466 A 10/1991 Matsuda et al.
5,091,243 A 2/1992 Tolbert et al.
5,141,542 A 8/1992 Fangeat et al.
5,178,923 A 1/1993 Andrieu et al.
5,211,500 A 5/1993 Takaki et al.
5,240,769 A 8/1993 Ueda et al.
5,288,552 A 2/1994 Hollenbaugh, Jr. et al.
5,296,292 A 3/1994 Butters
5,327,714 A 7/1994 Stevens et al.
5,333,442 A 8/1994 Berger
5,378,522 A 1/1995 Lagomarsino
5,429,869 A 7/1995 McGregor et al.
5,441,790 A 8/1995 Ratigan
5,497,608 A 3/1996 Matsumoto et al.
5,501,879 A 3/1996 Murayama
5,506,043 A 4/1996 Lilani
5,525,003 A 6/1996 Williams et al.
5,643,516 A 7/1997 Raza et al.
5,651,572 A 7/1997 St. Germain
5,669,214 A 9/1997 Kopanakis
5,699,657 A 12/1997 Paulson
5,711,243 A 1/1998 Dunham
5,718,532 A 2/1998 Mower
5,727,833 A 3/1998 Coe
5,802,839 A 9/1998 Van Hook
5,822,791 A 10/1998 Baris
5,826,421 A 10/1998 Wilcox et al.
5,852,926 A 12/1998 Breedlove
5,873,758 A 2/1999 Mullins
5,904,438 A 5/1999 Vaseghi et al.
5,931,076 A 8/1999 Ryan
5,943,963 A 8/1999 Beals
5,978,638 A 11/1999 Tanaka et al.
6,015,618 A 1/2000 Orima
6,033,213 A 3/2000 Halvorsen, Jr.
6,045,571 A 4/2000 Hill et al.
6,085,628 A 7/2000 Street et al.
6,122,847 A 9/2000 Treu et al.
6,146,759 A 11/2000 Land
6,164,053 A 12/2000 O'Donnell et al.
6,265,039 B1 7/2001 Drinkwater et al.
6,295,799 B1 10/2001 Baranda
6,341,550 B1 1/2002 White
6,365,070 B1 4/2002 Stowell et al.
6,405,519 B1 6/2002 Shaikh et al.
6,410,140 B1 6/2002 Land et al.
6,422,118 B1 7/2002 Edwards
6,484,423 B1 11/2002 Murray
3,524,690 A1 2/2003 Dyksterhouse
6,592,987 B1 7/2003 Sakamoto et al.
6,601,378 B1 8/2003 Fritsch et al.
6,704,535 B2 3/2004 Kobayashi et al.
6,876,798 B2 4/2005 Triplett et al.
6,881,793 B2 4/2005 Sheldon et al.
6,916,533 B2 7/2005 Simmelink et al.
6,945,153 B2 9/2005 Knudsen et al.
7,051,664 B2 5/2006 Robichaud et al.
7,093,416 B2 8/2006 Johnson et al.
7,127,878 B1 10/2006 Wilke et al.
7,134,267 B1 11/2006 Gilmore et al.
7,137,617 B2 11/2006 Sjostedt
7,165,485 B2 1/2007 Smeets et al.
7,168,231 B1 1/2007 Chou et al.
7,172,878 B1 2/2007 Nowak et al.
7,182,900 B2 2/2007 Schwamborn et al.
7,240,475 B2 7/2007 Smeets et al.
7,296,394 B2 11/2007 Clough et al.
7,331,269 B2 2/2008 He et al.
7,367,176 B1 5/2008 Gilmore et al.
7,389,973 B1 6/2008 Chou et al.
7,415,783 B2 8/2008 Huffman et al.
7,437,869 B1 10/2008 Chou et al.
7,472,502 B2 1/2009 Gregory et al.
7,475,926 B2 1/2009 Summars
7,568,419 B2 8/2009 Bosman

(56) References Cited

U.S. PATENT DOCUMENTS

| | | | | |
|---|---|---|---|---|
| 7,637,549 | B2 | 12/2009 | Hess | |
| 7,681,934 | B2 | 3/2010 | Harada et al. | |
| 7,735,308 | B1 | 6/2010 | Gilmore et al. | |
| 7,739,863 | B1 | 6/2010 | Chou et al. | |
| 7,743,596 | B1 | 6/2010 | Chou et al. | |
| 7,784,258 | B2 | 8/2010 | Hess | |
| 7,823,496 | B2 | 11/2010 | Bosman et al. | |
| 7,849,666 | B2 | 12/2010 | Kirth et al. | |
| 7,908,955 | B1 | 3/2011 | Chou et al. | |
| 7,918,079 | B2 | 4/2011 | Bloch | |
| 8,109,071 | B2 | 2/2012 | Gilmore | |
| 8,109,072 | B2 | 2/2012 | Chou et al. | |
| 8,171,713 | B2 | 5/2012 | Gilmore et al. | |
| 8,171,714 | B2 | 5/2012 | Wienke et al. | |
| 8,302,374 | B2 | 11/2012 | Marissen et al. | |
| 8,341,930 | B1 | 1/2013 | Chou et al. | |
| 8,387,505 | B2 | 3/2013 | Chou et al. | |
| 2003/0200740 | A1 | 10/2003 | Tao et al. | |
| 2003/0226347 | A1 | 12/2003 | Smith et al. | |
| 2004/0025486 | A1 | 2/2004 | Takiue | |
| 2005/0062303 | A1* | 3/2005 | Hess | 294/74 |
| 2005/0172605 | A1 | 8/2005 | Vancompernolle et al. | |
| 2006/0048494 | A1 | 3/2006 | Wetzels et al. | |
| 2006/0048497 | A1 | 3/2006 | Bloch | |
| 2006/0179619 | A1 | 8/2006 | Pearce et al. | |
| 2006/0213175 | A1 | 9/2006 | Smith et al. | |
| 2007/0063522 | A1 | 3/2007 | Byrne | |
| 2007/0079695 | A1 | 4/2007 | Bucher et al. | |
| 2007/0137163 | A1 | 6/2007 | Hess | |
| 2007/0144134 | A1 | 6/2007 | Kajihara | |
| 2007/0169457 | A1 | 7/2007 | Kijesky | |
| 2007/0266693 | A1 | 11/2007 | Kato et al. | |
| 2009/0047475 | A1 | 2/2009 | Jeon | |
| 2011/0067275 | A1 | 3/2011 | Doan | |
| 2011/0083415 | A1 | 4/2011 | Marissen et al. | |
| 2011/0197564 | A1 | 8/2011 | Zachariades et al. | |
| 2011/0269360 | A1 | 11/2011 | Mueller | |
| 2012/0121843 | A1 | 5/2012 | Lebel et al. | |
| 2012/0198808 | A1 | 8/2012 | Bosman et al. | |
| 2012/0244333 | A1 | 9/2012 | Aksay et al. | |
| 2012/0260620 | A1 | 10/2012 | Kim et al. | |
| 2012/0266583 | A1 | 10/2012 | Crozier et al. | |
| 2012/0297746 | A1 | 11/2012 | Chou et al. | |

FOREIGN PATENT DOCUMENTS

| | | |
|---|---|---|
| EP | 0374067 | 6/1990 |
| EP | 0785163 | 7/1997 |
| EP | 2130969 | 12/2009 |
| JP | 1260080 | 10/1989 |
| JP | 2242987 | 9/1990 |
| JP | 3033285 | 2/1991 |
| JP | 2000212884 | 8/2000 |
| JP | 2004126505 | 4/2001 |
| JP | 2009293181 | 12/2009 |
| KR | 1019900010144 | 7/1990 |
| KR | 1020090044381 | 5/2009 |
| RU | 1791325 | 1/1993 |
| RU | 2295144 | 10/2007 |
| SU | 1723004 | 3/1992 |
| WO | 03102295 | 12/2003 |
| WO | 2004067434 | 12/2004 |
| WO | 2008144046 | 11/2008 |
| WO | 2008144047 | 11/2008 |
| WO | 2008144048 | 11/2008 |

OTHER PUBLICATIONS

International Searching Authority, ISR PCT/US2013/059081, Dec. 26, 2013, 7 pages.

H. A. McKenna et al., "Handbook of fibre rope technology", 2004, pp. 88, 89, 100, Woodhead Publishing Limited, England, CRC Press LLC, USA.

Kaneya Seiko Co., Ltd., "Super Triple Cross Rope", 2007, 3 pages.

Timberland Equipment Limited, "Gatortail Rope Synthetic Pulling Rope", 2010, 5 pages.

Bridon, "Fibre Rope Catalogue: M Steel Winchline", 2011, p. 17.

Bridon, "Fibre Rope Catalogue: TQ12", 2011, p. 18.

Samson Rope Technologies, Inc., "Offshore Product and Technical Guide", Jul. 2011, 8 pages.

US District Court, *Samson Rope Technologies, Inc.* v. *Yale Cordage, Inc.* Case 2:11-cv-00328, Document 1, Complaint (2), DI 001-2011-02-24, 5 pages.

US District Court, *Samson Rope Technologies, Inc.* v. *Yale Cordage, Inc.* Case 2:11-cv-00328-JLR, Document 5, Notice to PTO, DI 005-2011-02-25, 1 page.

US District Court, *Samson Rope Technologies, Inc.* v. *Yale Cordage, Inc.* Case 2:11-cv-00328-JLR, Document 12, Answer, DI 012-2011-05-10, 6 pages.

Samson Rope Technologies, Inc., "M-8 Offshore Rope", Mar. 2008, 1 page.

Entec, http://www.entec.com/pultrusion.shtml, "Pultrusion Equipment", Nov. 2006, 4 pages.

Pultrusion Industry Council, http://www.acmanet.org/pic/products/description.htm, "products & process: process description", 2001, 2 pages.

Samson Rope Technologies, Inc., "Innovative Chafe Protection Solutions for High Performance Ropes", 2006, 4 pages.

Samson Rope Technologies, Inc., "Dynalene Installation Instructions for Covering 12-Strand Rope", 2005, 12 pages.

Samson Rope Technologies, Inc., "Samson Deep Six Performs Beyond Expectation", Sep. 10, 2008, 2 pages.

Samson Rope Technologies, Inc., "Samson Offshore Expansion Celebrated", Feb. 18, 2009, 2 pages.

Tencom Ltd., http://www.tencom.com/02/pultrusion.htm, "Pultrusion Process", 2006, 2 pages.

Pasternak, Shelton, & Gilmore, "Synthetic 'Mud Ropes' for Offshore Mooring Applications—Field History and Testing Data", Sep. 2011, 8 pages.

* cited by examiner

ROPE SYSTEMS AND METHODS FOR USE AS A ROUND SLING

TECHNICAL FIELD

The present invention relates to rope systems and methods and, more specifically, to rope systems and methods configured to be used as a round sling.

BACKGROUND

A lifting sling is a structure, typically flexible, that allows a connection to be made between first and second attachment points to allow an item to be displaced or, more typically, lifted. For example, a crane may be connected to a load using a sling to allow the crane to lift the load. In this case, the first attachment point may be a hook on the end of the crane, and the second attachment point may be a hook formed by a cargo net or the like that secures the load for lifting.

Slings typically comprise at least an elongate, flexible body having end fittings connected to or formed at each end. The elongate body may be made of, as examples, fabric webbing, wire rope, chain, steel wire mesh, and/or rope round slings. The present invention is of particular significance when embodied as a rope round sling.

A rope round sling typically comprises a load bearing structure comprising load bearing material. The load bearing material typically takes the form of natural or synthetic fibers. The fibers are typically combined to form yarns, and the yarns are typically combined to form strands and/or other subcomponents. The load bearing structure may thus take the form of a conventional rope structure spliced together or otherwise formed in the shape of an endless loop.

The load bearing structure is typically covered by a jacket to protect the load bearing structure from abrasion and/or potentially deleterious effects of the elements. The jacket may take the form of a fabric panel structure that is wrapped around the entire endless loop formed by the load bearing structure and secured in place. Alternatively, the jacket may take the form of a cylindrical fabric tube adapted to cover a central portion of the endless loop such that opposing portions of the endless loop form eyes that extend out of each end of the cylindrical fabric tube.

A rope round sling thus may be configured, with or without a jacket, to form first and second eyes adapted to be connected between the first and second attachment points as generally described above. To use a rope round sling in the context of a crane as described above, the crane hook will be passed through a first eye formed by a first portion of the load bearing structure and the load hook would be passed through a second eye formed by a second portion of the load bearing structure opposing the first portion. When the crane hook is raised, the load bearing structure will be placed in tension such that the load is raised with the crane hook.

The need exists for improved rope round slings that are capable of lifting increased loads for a given weight per length unit of the load bearing material.

SUMMARY

The present invention may be embodied as a rope assembly that is adapted to extend between first and second attachment points comprises a line arranged to define a plurality of loops and at least one pair of organizers. The at least one pair of organizers is configured to engage the line such that line segments of the line between the at least one pair of organizers are maintained in a desired relationship with each other and such that the desired relationship facilitates transfer of loads through the rope assembly between the first and second attachment points.

The present invention may also be embodied as a rope system adapted to extend between first and second attachment points comprising first and second line assemblies. The first rope assembly comprises a first line and at least one pair of organizers configured to engage the first line such that line segments of the first line between the at least one pair of organizers are maintained in a first desired relationship with each other. The second rope assembly comprises a second line and at least one pair of organizers configured to engage the line such that line segments of the second line between the at least one pair of organizers are maintained in a second desired relationship with each other. The first and second desired relationships facilitate transfer of loads through the rope system between the first and second attachment points.

The present invention may also be embodied as a method of connecting first and second attachment points comprising the following steps. A line is arranged to define a plurality of loops. At least one pair of organizers is arranged to engage the line such that line segments of the line between the at least one pair of organizers are maintained in a desired relationship with each other and the desired relationship facilitates transfer of loads through the rope assembly between the first and second attachment points.

DETAILED DESCRIPTION

The rope assembly of the present invention may take a number of different forms, and a number of examples of the present invention will be discussed separately below.

1. First Example Rope Assembly

Figure 1:
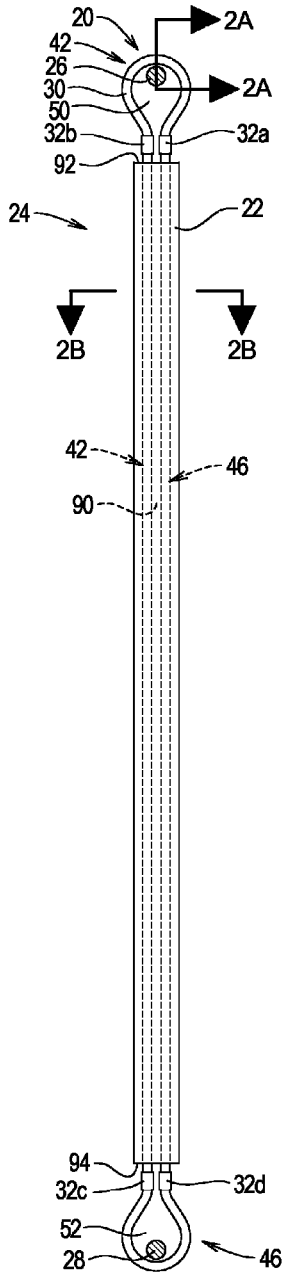
FIG. 1 is a side elevation view of a sling system incorporating a first example rope assembly of the present invention.

Referring initially to FIGS. 1-5 of the drawing, depicted therein is a first example rope assembly 20 constructed in accordance with, and embodying, the principles of the present invention. The first example rope assembly 20 may be used alone as a conventional round sling. However, as depicted in FIG. 1, the first example rope assembly 20 may be combined with an example jacket 22 to form a sling system 24. In FIG. 1, the sling system 24 extends between first and second attachment points 26 and 28. During normal use of the sling system 24, the rope assembly 20 is typically held in tension between the first and second attachment points 26 and 28. The attachment points 26 and 28 are not part of the present invention and will be described herein only to that extent necessary for a complete understanding of the present invention.

The first example rope assembly 20 comprises a line 30 formed in an endless loop and first, second, third, and fourth organizers 32*a*, 32*b*, 32*c*, and 32*d*. In the example rope assembly 20, the first and second organizers 32*a* and 32*b* define a first pair of organizers, and the third and fourth organizers 32*c* and 32*d* define a second pair of organizers.

The example line 30 is "coiled" such that a plurality (two or more) of loops 34 is formed. The example line 30 depicted in FIG. 3 comprises six loops, and loops 34*a*, 34*b*, 34*c*, 34*d*, 34*e*, and 34*f* are identified therein. The example line 30 is formed by a length of rope cut to or formed in a predetermined length and spliced together at a splice region 36.

The example line 30 of the first example rope assembly 20 is typically formed of synthetic fibers such as polyester and/or high modulus polyethylene (HMPE), but natural fibers may be used. The example line 30 of the first example jacket 22 may be formed of one or more of the following materials: polyester, polyolefin, polyamide (PA), polyethylene terephthalate/polyethersulfone (PET/PES), polypropylene (PP), polyethylene (PE), high modulus polyethylene (HMPE), liquid crystal polymer (LCP), Para-Aramid, poly p-phenylene-2,6-benzobisoxazole (PBO) fibers, high modulus polypropylene (HMPP), and PP/PE blends, but other materials may be used depending on considerations such as characteristics of the line 30, the nature of the operating environment, cost, and the like.

The example organizers 32*a*, 32*b*, 32*c*, and 32*d* are arranged at four locations relative to the line 30 such that first, second, third, and fourth loop portions 40, 42, 44, and 46 of the loops 34 are defined. In particular, the first loop portion 40 is between the first and fourth organizers 32*a* and 32*d*, the second loop portion 42 is between the first and second organizers 32*a* and 32*b*, the third loop portion 44 is between the second and third organizers 32*b* and 32*c*, and the fourth loop portion 46 is between the third and fourth organizers 32*c* and 32*d*. Typically, the first and third loop portions 40 and 44 are longer than the second and fourth loop portions 42 and 46. Referring for a moment back to FIG. 1, it can be seen that the second loop portion 42 generally defines a first eye 50 and the fourth loop portion 46 generally defines a second eye 52.

Figure 3:
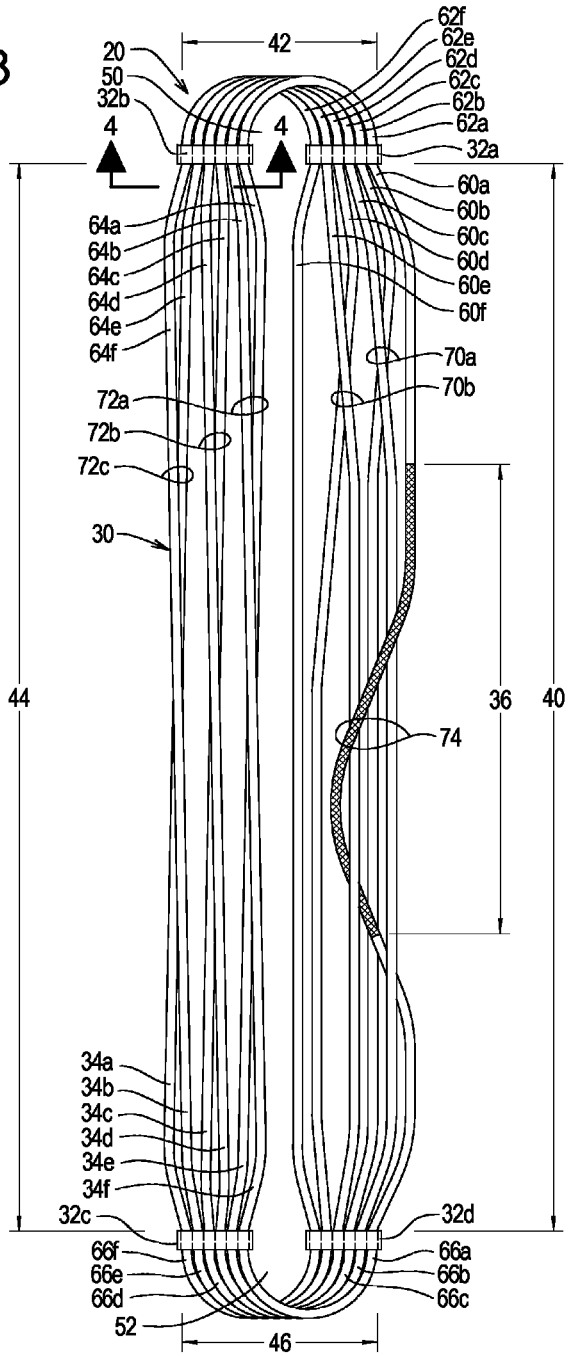
FIG. 3 is a somewhat schematic top plan view of the first example rope assembly depicted in FIG. 1.

Because the example line 30 is coiled to define a plurality of the loops 34, each of the loop portions 40, 42, 44, and 46 defines or is associated with a plurality of segments of the line 30. In particular, the first loop portion 40 defines or is associated with a plurality of first portion line segments 60, the second loop portion 42 defines or is associated with a plurality of second portion line segments 62, the third loop portion 44 defines or is associated with a plurality of third portion line segments 64, and the fourth loop portion 46 defines or is associated with a plurality of fourth portion line segments 66. Given that the example line 30 is coiled to define the six loops 34*a*, 34*b*, 34*c*, 34*d*, 34*e*, and 34*f*, the first example rope assembly 20 comprises six first portion line segments 60*a*, 60*b*, 60*c*, 60*d*, 60*e*, and 60*f*, six second portion line segments 62*a*, 62*b*, 62*c*, 62*d*, 62*e*, and 62*f*, six third portion line segments 64*a*, 64*b*, 64*c*, 64*d*, 64*e*, and 64*f*, and six fourth portion line segments 66*a*, 66*b*, 66*c*, 66*d*, 66*e*, and 66*f* as shown in FIG. 3.

During normal use of the sling system 24, the eyes 50 and 52 engage the attachment points 26 and 28, respectively, such that the rope assembly 20 is held in tension between the attachment points 26 and 28. The attachment points 26 and 28 are typically fittings or other hardware, and one or both of the attachment points 26 and 28 may be formed by fittings such as a hook, eyelet, clip, carabiner, or the like.

The example line rope assembly 20 is further formed such that the second portion line segments 62*a*, 62*b*, 62*c*, 62*d*, 62*e*, and 62*f* and the fourth portion line segments 66*a*, 66*b*, 66*c*, 66*d*, 66*e*, and 66*f* are substantially parallel and do not cross or substantially overlap when the attachment points 26 and 28 apply tension loads to the first and second eyes 50 and 52 under normal use of the rope assembly 20. On the other hand, the first example rope assembly 20 is formed such that at least one of the first portion line segments 60*a*, 60*b*, 60*c*, 60*d*, 60*e*, and 60*f* and at least one of the third portion line segments 64*a*, 64*b*, 64*c*, 64*d*, 64*e*, and 64*f* are not parallel and in fact do cross each other when tension loads are applied on the first and second eyes 50 and 52 during normal use of the rope assembly 20.

The first example rope assembly 20 is formed such that the line 30 defines two first portion segment pairs 70*a* and 70*b*, three second portion segment pairs 72*a*, 72*b*, and 72*c*, and a single first portion segment bundle 74. The term "pair" as used herein refers to exactly two line segments that cross each other in the first or third loop portions 40 and 44. The term "bundle" as used herein refers to any group of line segments in the first or third loop portions 40 and 44 where at least one crossing line segment in the group crosses at least two other crossed line segments in that group. In a bundle, any crossing line segment may go over and/or over the crossed line segments. A crossing line segment in a group may further cross any one or more of the crossed line segments multiple times.

In particular, in the first loop portion 40 of the example rope assembly 20 the line segment 60*c* crosses the line segment 60*b* to form the first portion segment pair 70*a*, and the line segment 60*e* crosses the line segment 60*d* to form the first portion segment pair 70*b*. In the third loop portion 44, the line segment 64*b* crosses the line segment 64*a* to form the second portion segment pair 72*a*, the line segment 64*d* crosses the second portion line segment 64*c* to form the second portion segment pair 72*b*, and the line segment 64*f* crosses the line segment 64*e* to form the second portion segment pair 72*c*.

In the first example rope assembly 20, the first portion segment bundle 74 is formed by crossing the line segment 60*a* over the line segments 60*c*, 60*b*, 60*e*, under the line segment 60*e*, over the line segment 60*b*, and under the line segment 60*c*. Further, as described above, the splice region 36 is formed in the line segment 60*a*, and the first portion segment bundle 74 is formed by arranging at least a portion of the splice region 36 such that the splice region 36 extends over and/or under at least one of the line segments 60*c*, 60*b*, and 60*e*. In the first example rope assembly 20, the splice region 36 extends over the line segments 60*c*, 60*b*, and 60*e*, under the line segment 60*e*, and over the line segment 60*b*. The line segment 60*f* of the first example rope assembly 20 does not form part of a segment pair or a segment bundle.

Figure 4:
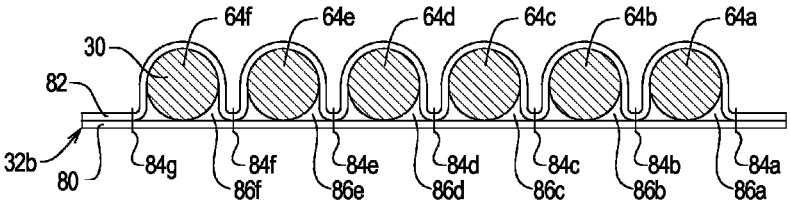
FIG. 4 is a section view taken along lines 4-4 in FIG. 3 depicting an example organizer that may be used by the first example rope assembly depicted in FIG. 1.

Turning now to FIG. 4 of the drawing, an example of an organizer 32 that may be used by the first example rope assembly 20 will be described in further detail. As indicated by lines 4-4 in FIG. 3, FIG. 4 depicts details of the example second organizer 32*b* depicted in FIG. 3. The first, third, and fourth organizers 32*a*, 32*c*, and 32*d* may be the same as the example second organizer 32*b* depicted in FIG. 4. However, it is not necessary that all of the organizers 32 have the same construction, and organizers other than the example organizer 32*b* depicted in FIG. 4 may be used in addition or instead for any of the organizers 32 of an example of the present invention.

The example organizer 32*b* comprises a first organizer structure 80, a second organizer structure 82, and at least one fastener 84. The at least one fastener 84 secures the second organizer structure 82 to the first organizer structure 80 to form at least one organizer opening 86. In particular, because the example line 30 is formed to define six of the loops 34, seven fasteners 84*a*, 84*b*, 84*c*, 84*d*, 84*e*, 84*f*, and 84*g* are employed by the example organizer 32*b*. In the example organizer 32*b*, the seven fasteners 84*a*, 84*b*, 84*c*, 84*d*, 84*e*, 84*f*, and 84*g* define six of the organizer openings 86*a*, 86*b*, 86*c*, 86*d*, 86*e*, and 86*f*, one for each of the loops 34*a*, 34*b*, 34*c*, 34*d*, 34*e*, and 34*f*. In particular, FIG. 4 illustrates that at least a portion of the third portion line segments 64*a*, 64*b*, 64*c*, 64*d*, 64*e*, and 64*f* extends into the organizer openings 86*a*, 86*b*, 86*c*, 86*d*, 86*e*, and 86*f*, respectively. The organizer openings 86 are sized and dimensioned to snugly receive the line segments 64 to organize the loops 34 as will be discussed in further detail below.

In the example organizer 32*b*, the first organizer structure 80 and the second organizer structure 82 are formed by fabric panels or webbing, and the fasteners 84 are formed by stitching that attaches the panels or webbing together. In the example organizer 32*b*, the webbing forming the example first organizer structure 80 is fiat, and the webbing forming the example second organizer structure 82 is folded to define the organizer openings 86, in which case the length of webbing forming the second organizer structure 82 is longer than the length of webbing forming the first organizer structure 82. However, both organizer structures 80 and 82 may made of the same length of webbing by appropriately spacing the distance between the stitches forming the fasteners 84 to form organizer openings appropriate for the line segments 64.

Alternatively, the organizers 32 may be formed by two rigid pieces that are snapped or welded together. As yet another alternative, a castable plastic, urethane, or other material may be poured around the segments with the loops held in a desired configuration and then allowed to harden to form a semi-rigid member that maintains the loops in the desired configuration. As another alternative, a fastening rope structure may be woven through the line segments with the loops in the desired configuration.

Figure 2A:
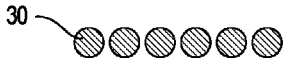
FIG. 2A is a section view taken along lines 2A-2A in FIG. 1.

In any case, the organizers 32 are configured to ensure that the second portion line segments 62 in the second portion 42 are held in desired relationships with each other and the third portion line segments 66 in the fourth portion 46 are held in desired relationships with each other during normal handling and use of the rope assembly 20. In particular, the desired relationships facilitate the formation of the first and second eyes 50 and 52 to improve the transfer of loads through the rope assembly 30 between the attachment points 26 and 28 and to the rope assembly 30 from the attachment points 26 and 28 through the eyes 50 and 52, respectively. In the example rope assembly 20, the desired relationship maintained by the organizers 32 substantially parallel, substantially non-crossing or non-overlapping relationship during normal handling and use of the rope assembly 20 as depicted in FIGS. 2A and 3 and as discussed above.

Figure 2B:
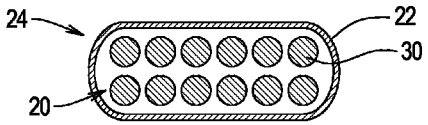
FIG. 2B is a section view taken along lines 2B-2B in FIG. 1.

The organizers 32 further ensure that the first portion line segments 60 in the first portion 40 are held in desired relationships with each other and third portion line segments 64 of the third portion 44 are held in desired relationships during normal handling and use of the rope assembly 20. In particular, the desired relationships facilitate the transfer of loads between the attachment points 26 and 28 through the rope assembly 30. In the example rope assembly 20, the desired relationships maintain the line segments 60 in the segment pairs 70 and bundles 74 and the line segments 64 in the segment pairs 72 as depicted in FIGS. 2B and 3 and as discussed above.

Although the example rope assembly 20 comprises four separate organizers 34*a*, 34*b*, 34*c*, and 34*d*, at least some (two or more) of these organizers may be combined into a single member or assembly. For example, the four separate organizers 334 depicted in FIGS. 1 and 3 may be combined into a first member or assembly performing the function of the organizers 32*a* and 32*b* and a second member or assembly performing the function of the organizers 32*c* and 32*d*.

Figure 5:
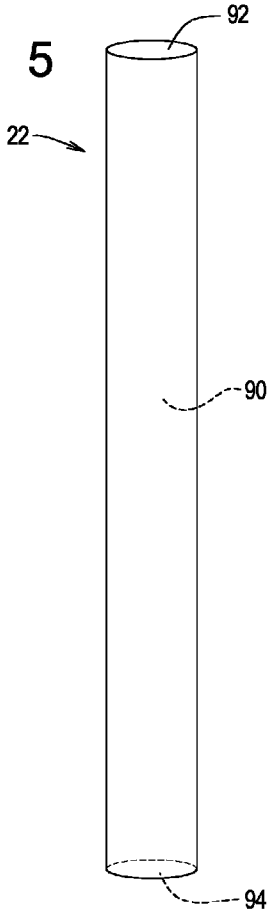
FIG. 5 is a perspective view of an example jacket that may be used by the example sling system depicted in FIG. 1.

Turning now to FIG. 5 of the drawing, the example jacket 22 will now be described in further detail. The example jacket 22 is a tubular structure defining a jacket cavity 90 and first and second jacket openings 92 and 94. A diameter of the tubular structure formed by the example jacket 22 should be sufficiently large to allow the eyes 50 or 52 to be passed therethrough during assembly, as will be described below, and to accommodate the first and third loop portions 40 and 44 in an assembled configuration. The diameter of the tubular structure forming the example jacket 22 should not be so large that the jacket 22 inadvertently disengages from the assembled configuration relative to the rope assembly 20.

The example jacket 22 is formed by a panel of fabric sewn along one edge to obtain the tubular structure as defined above. Alternatively, the example jacket 22 may be formed by a woven or braided rope structure having a similar tubular structure. In any case, example jacket 22 may be formed of one or more of the following materials: polyester, polyolefin, polyamide (PA), polyethylene terephthalate/polyethersulfone (PET/PES), polypropylene (PP), polyethylene (PE), high modulus polyethylene (HMPE), liquid crystal polymer (LCP), Para-Aramid, poly p-phenylene-2,6-benzobisoxazole (PBO) fibers, high modulus polypropylene (HMPP), and PP/PE blends, but other materials may be used depending on considerations such as characteristics of the line 30, the nature of the operating environment, cost, and the like.

To form the first example sling system 24, one or both of the first example rope assembly 20 and jacket 22 are displaced relative to the other such the first eye 50 of the first example rope assembly 20 extends into the jacket cavity 90 through the second jacket opening 94. Continued relative displacement of the rope assembly 20 and the jacket 22 causes the first eye 50 to exit the jacket cavity 90 through the first jacket opening 92. When the first and second eyes 50 and 52 are arranged adjacent to the first and second jacket openings 92 and 94 as shown in FIG. 1, the jacket 22 is in the assembled configuration relative to the rope assembly 20, and the first example sling system 24 is formed. In the assembled configuration, the first and third loop portions 40 and 44 are arranged substantially within the jacket cavity 90 and are thus protected by the jacket 22.

During normal use of the first example sling system 24, the eyes 50 and 52 are each engaged with external structures (not shown) such as hooks or other fittings associated with first and second attachment points. The organizers 32 maintain the second and third loop portions 40 and 44 such that the second portion line segments 62 and fourth portion line segments 66 are held in a substantially parallel configuration as depicted in FIG. 2A when the eyes 50 and 52 engage the external structure. The first portion line segments 60 and second portion line segments 64 are arranged within the jacket cavity as depicted in FIG. 2B during normal use of the example sling system 24. The example rope assembly 20 bears tension loads on the eyes 50 and 52, and the jacket 22 protects the portions of the example rope assembly not forming the eyes 50 and 52.

In addition, a separate chafe protection structure as disclosed in co-pending U.S. patent application Ser. No. 13/594,681 may be arranged to protect the portion of the rope assembly 20 forming the eyes 50 and 52 that are in contact with the external structure defined by the first and second attachment points. The '681 application is incorporated herein by reference.

2. Second Example Rope Assembly

Figure 6:
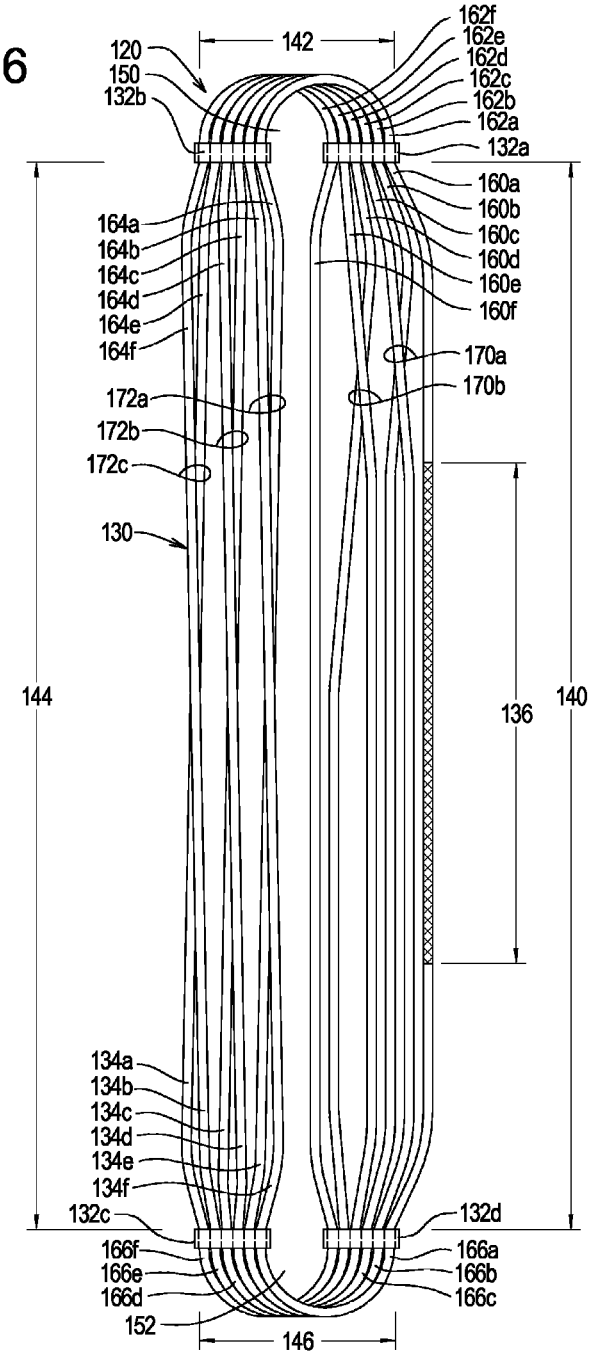
FIG. 6 is a somewhat schematic top plan view of a second example rope assembly of the present invention.

Referring now to FIG. 6 of the drawing, depicted at 120 therein is a second example rope assembly constructed in accordance with, and embodying, the principles of the present invention. Like the first example rope assembly 20 described above, the second example rope assembly 120 may be used alone as a conventional round sling or may be combined with a jacket such as the jacket 22 described above to form a sling system. During normal use, the rope assembly 120 extends between two attachment points such as the attachment points 26 and 28 described above.

The second example rope assembly 120 comprises a line 130 formed in an endless loop and first, second, third, and fourth organizers 132*a*, 132*b*, 132*c*, and 132*d*. Like the first example line 20 described above, the example line 130 is "coiled" such that a plurality (two or more) of loops 134 is formed. The example line 130 depicted in FIG. 6 comprises six loops, and loops 134*a*, 134*b*, 134*c*, 134*d*, 134*e*, and 134*f* are identified therein. The example line 130 is formed by a length of rope cut to or formed in a predetermined length and spliced together at a splice region 136.

The second example line 130 of the second example rope assembly 120 is typically formed of synthetic fibers such as polyester and/or high modulus polyethylene (HMPE), but natural fibers may be used. The example line 130 of the second example jacket 122 may be formed of one or more of the following materials: polyester, polyolefin, polyamide (PA), polyethylene terephthalate/polyethersulfone (PET/PES), polypropylene (PP), polyethylene (PE), high modulus polyethylene (HMPE), liquid crystal polymer (LCP), Para-Aramid, poly p-phenylene-2,6-benzobisoxazole (PBO) fibers, high modulus polypropylene (HMPP), and PP/PE blends, but other materials may be used depending on considerations such as characteristics of the line 130, the nature of the operating environment, cost, and the like.

The example organizers 132*a*, 132*b*, 132*c*, and 132*d* are arranged at four locations relative to the line 130 such that first, second, third, and fourth loop portions 140, 142, 144, and 146 of the loops 134 are defined. In particular, the first loop portion 140 is between the first and fourth organizers 132*a* and 132*d*, the second loop portion 142 is between the first and second organizers 132*a* and 132*b*, the third loop portion 144 is between the second and third organizers 132*b* and 132*c*, and the fourth loop portion 146 is between the third and fourth organizers 132*c* and 132*d*. Typically, the first and third loop portions 140 and 144 are longer than the second and fourth loop portions 142 and 146. Referring for a moment back to FIG. 6, it can be seen that the second loop portion 142 generally defines a first eye 150 and the fourth loop portion 146 generally defines a second eye 152.

Because the example line 130 is coiled to define a plurality of the loops 134, each of the loop portions 140, 142, 144, and 146 defines or is associated with a plurality of segments of the line 130. In particular, the first loop portion 140 defines or is associated with a plurality of first portion line segments 160, the second loop portion 142 defines or is associated with a plurality of second portion line segments 162, the third loop portion 144 defines or is associated with a plurality of third portion line segments 164, and the fourth loop portion 146 defines or is associated with a plurality of fourth portion line segments 166. Given that the example line 130 is coiled to define the six loops 134*a*, 134*b*, 134*c*, 134*d*, 134*e*, and 134*f*, the second example rope assembly 120 comprises six first portion line segments 160*a*, 160*b*, 160*c*, 160*d*, 160*e*, and 160*f*, six second portion line segments 162*a*, 162*b*, 162*c*, 162*d*, 162*e*, and 162*f*, six third portion line segments 164*a*, 164*b*, 164*c*, 164*d*, 164*e*, and 164*f*, and six fourth portion line segments 166*a*, 166*b*, 166*c*, 166*d*, 166*e*, and 166*f* as shown in FIG. 6.

The example line rope assembly 120 is further formed such that the second portion line segments 162*a*, 162*b*, 162*c*, 162*d*, 162*e*, and 162*f* and the fourth portion line segments 166*a*, 166*b*, 166*c*, 166*d*, 166*e*, and 166*f* are substantially parallel and do not cross or substantially overlap when tension loads are applied to the first and second eyes 150 and 152 under normal use of the rope assembly 120. On the other hand, the second example rope assembly 120 is formed such that at least one of the first portion line segments 160*a*, 160*b*, 160*c*, 160*d*, 160*e*, and 160*f* and at least one of the third portion line segments 164*a*, 164*b*, 164*c*, 164*d*, 164*e*, and 164*f* are not parallel and in fact do cross each other when tension loads are applied on the first and second eyes 150 and 152 during normal use of the rope assembly 120.

The second example rope assembly 120 is formed such that the line 130 defines two first portion segment pairs 170*a* and 170*b* and three second portion segment pairs 172*a*, 172*b*, and 172*c*. In particular, in the first loop portion 140 the line segment 160*c* crosses the line segment 160*b* to form the first portion segment pair 170*a*, and the line segment 160*e* crosses the line segment 160*d* to form the first portion segment pair 170*b*. In the third loop portion 144, the line segment 164*b* crosses the line segment 164*a* to form the second portion segment pair 172*a*, the line segment 164*d* crosses the second portion line segment 164*c* to form the second portion segment pair 172*b*, and the line segment 164*f* crosses the line segment 164*e* to form the second portion segment pair 172*c*.

In the second example rope assembly 120, neither the line segment 160*a* nor the line segment 160*f* of the first example rope assembly 20 forms part of a segment pair or a segment bundle. Further, the splice region 136 is formed in the line segment 160*a*, and the splice region 136 does not cross over or under any of the other line segments 160*b*, 160*c*, 160*d*, 160*e* and/or 160*f* in the second example rope assembly 120.

The organizers 132 may be constructed in the same manner as the example organizers 32 described above and will not be described herein in further detail.

During normal use of the second example rope assembly 120, the eyes 150 and 152 are each engaged with external structures (not shown) such as hooks or other fittings associated with first and second attachment points. The organizers 132 maintain the second and fourth loop portions 142 and 146 such that the second portion line segments 162 and fourth portion line segments 166 are held in a substantially parallel configuration when the eyes 150 and 152 engage the external structure. The second example rope assembly 120 thus bears tension loads on the eyes 150 and 152.

The second example rope assembly 120 may be used alone or in combination with a jacket to form a sling system. In this case the sling system will be assembled in the same manner as the first example sling system 24 described above.

3. Third Example Rope Assembly

Figure 7:
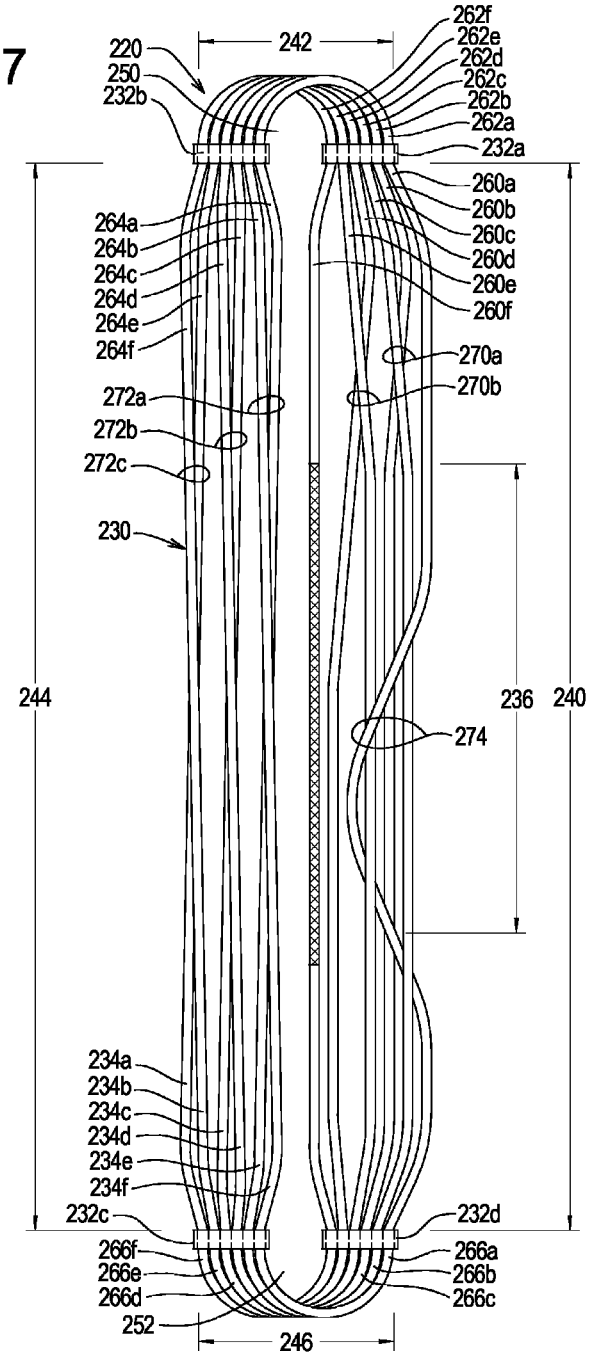
FIG. 7 is a somewhat schematic top plan view of a third example rope assembly of the present invention.

Referring now to FIG. 7 of the drawing, depicted at 220 therein is a third example rope assembly constructed in accordance with, and embodying, the principles of the present invention. Like the first example rope assembly 20 described above, the third example rope assembly 220 may be used alone as a conventional round sling or may be combined with a jacket such as the jacket 22 described above to form a sling system. During normal use, the rope assembly 220 extends between two attachment points such as the attachment points 26 and 28 described above.

The third example rope assembly 220 comprises a line 230 formed in an endless loop and first, second, third, and fourth organizers 232*a*, 232*b*, 232*c*, and 232*d*. Like the first example line 20 described above, the example line 230 is "coiled" such that a plurality (two or more) of loops 234 is formed. The example line 230 depicted in FIG. 7 comprises six loops, and loops 234*a*, 234*b*, 234*c*, 234*d*, 234*e*, and 234*f* are identified therein. The example line 230 is formed by a length of rope cut to or formed in a predetermined length and spliced together at a splice region 236.

The third example line 230 of the third example rope assembly 220 is typically formed of synthetic fibers such as polyester and/or high modulus polyethylene (HMPE), but natural fibers may be used. The example line 230 of the third example jacket 222 may be formed of one or more of the following materials: polyester, polyolefin, polyamide (PA), polyethylene terephthalate/polyethersulfone (PET/PES), polypropylene (PP), polyethylene (PE), high modulus polyethylene (HMPE), liquid crystal polymer (LCP), Para-Aramid, poly p-phenylene-2,6-benzobisoxazole (PBO) fibers, high modulus polypropylene (HMPP), and PP/PE blends, but other materials may be used depending on considerations such as characteristics of the line 230, the nature of the operating environment, cost, and the like.

The example organizers 232*a*, 232*b*, 232*c*, and 232*d* are arranged at four locations relative to the line 230 such that first, second, third, and fourth loop portions 240, 242, 244, and 246 of the loops 234 are defined. In particular, the first loop portion 240 is between the first and fourth organizers 232*a* and 232*d*, the second loop portion 242 is between the first and second organizers 232*a* and 232*b*, the third loop portion 244 is between the second and third organizers 232*b* and 232*c*, and the fourth loop portion 246 is between the third and fourth organizers 232*c* and 232*d*. Typically, the first and third loop portions 240 and 244 are longer than the second and fourth loop portions 242 and 246. Referring for a moment back to FIG. 7, it can be seen that the second loop portion 242 generally defines a first eye 250 and the fourth loop portion 246 generally defines a second eye 252.

Because the example line 230 is coiled to define a plurality of the loops 234, each of the loop portions 240, 242, 244, and 246 defines or is associated with a plurality of segments of the line 230. In particular, the first loop portion 240 defines or is associated with a plurality of first portion line segments 260, the second loop portion 242 defines or is associated with a plurality of second portion line segments 262, the third loop portion 244 defines or is associated with a plurality of third portion line segments 264, and the fourth loop portion 246 defines or is associated with a plurality of fourth portion line segments 266. Given that the example line 230 is coiled to define the six loops 234*a*, 234*b*, 234*c*, 234*d*, 234*e*, and 234*f*, the third example rope assembly 220 comprises six first portion line segments 260*a*, 260*b*, 260*c*, 260*d*, 260*e*, and 260*f*, six second portion line segments 262*a*, 262*b*, 262*c*, 262*d*, 262*e*, and 262*f*, six third portion line segments 264*a*, 264*b*, 264*c*, 264*d*, 264*e*, and 264*f*, and six fourth portion line segments 266*a*, 266*b*, 266*c*, 266*d*, 266*e*, and 266*f* as shown in FIG. 7.

The example line rope assembly 220 is further formed such that the second portion line segments 262*a*, 262*b*, 262*c*, 262*d*, 262*e*, and 262*f* and the fourth portion line segments 266*a*, 266*b*, 266*c*, 266*d*, 266*e*, and 266*f* are substantially parallel and do not cross or substantially overlap when tension loads are applied to the first and second eyes 250 and 252 under normal use of the rope assembly 220. On the other hand, the third example rope assembly 220 is formed such that at least one of the first portion line segments 260*a*, 260*b*, 260*c*, 260*d*, 260*e*, and 260*f* and at least one of the third portion line segments 264*a*, 264*b*, 264*c*, 264*d*, 264*e*, and 264*f* are not parallel and in fact do cross each other when tension loads are applied on the first and second eyes 250 and 252 during normal use of the rope assembly 220.

The third example rope assembly 220 is formed such that the line 230 defines two first portion segment pairs 270*a* and 270*b*, three second portion segment pairs 272*a*, 272*b*, and 272*c*, and a single first portion segment bundle 274. In particular, in the first loop portion 240 the line segment 260*c* crosses the line segment 260*b* to form the first portion segment pair 270*a*, and the line segment 260*e* crosses the line segment 260*d* to form the first portion segment pair 270*b*. In the third loop portion 244, the line segment 264*b* crosses the line segment 264*a* to form the second portion segment pair 272*a*, the line segment 264*d* crosses the second portion line segment 264*c* to form the second portion segment pair 272*b*, and the line segment 264*f* crosses the line segment 264*e* to form the second portion segment pair 272*c*.

In the third example rope assembly 220, the first portion segment bundle 274 is formed by crossing the line segment 260*a* over the line segments 260*c*, 260*b*, 260*e*, under the line segment 260*e*, over the line segment 260*b*, and under the line segment 260*c*.

Further, in the third example rope assembly 220, the splice region 236 is formed in the line segment 260*f*. Accordingly, the line segment 260*f* of the third example rope assembly 220 does not form part of a segment pair or a segment bundle, and, unlike in the first example rope assembly 20, the splice region 236 of the third example rope assembly 220 does not form a part of the first portion segment bundle 274.

The organizers 232 may be constructed in the same manner as the example organizers 32 described above and will not be described herein in further detail.

During normal use of the third example rope assembly 220, the eyes 250 and 252 are each engaged with external structures (not shown) such as hooks or other fittings associated with first and second attachment points. The organizers 232 maintain the second and fourth loop portions 242 and 246 such that the second portion line segments 262 and fourth portion line segments 266 are held in a substantially parallel configuration when the eyes 250 and 252 engage the external structure. The third example rope assembly 220 thus bears tension loads on the eyes 250 and 252.

The third example rope assembly 220 may be used alone or in combination with a jacket to form a sling system. In this case the sling system will be assembled in the same manner as the third example sling system 24 described above.

4. Fourth Example Rope Assembly

Figure 8:
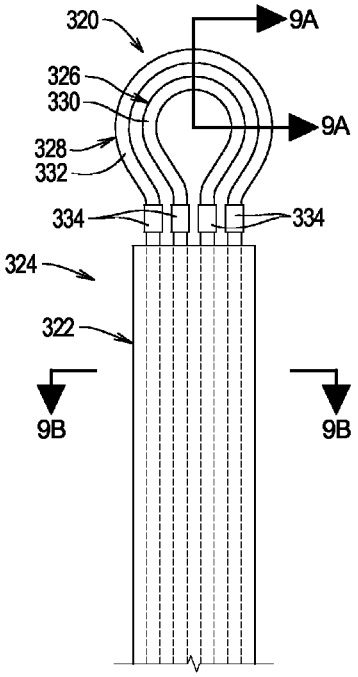
FIG. 8 is a partial, side elevation view of a sling system incorporating a fourth example rope assembly of the present invention.
Figure 9A:
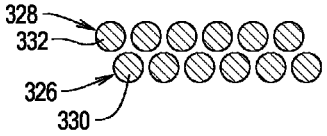
FIG. 9A is a section view taken along lines 9A-9A in FIG. 8.
Figure 9B:
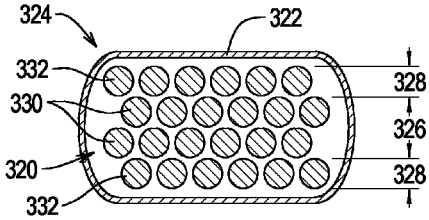
FIG. 9B is a section view taken along lines 9B-9B in FIG. 8.

Referring now to FIGS. 8, 9A, and 9B of the drawing, depicted therein is an example rope system 320 constructed in accordance with, and embodying, the principles of the present invention. The example rope system 320 may be used alone as a conventional round sling. However, as depicted in FIG. 8, the example rope system 320 may be combined with an example jacket 322 to form a sling system 324. The example rope system 320 comprises first and second rope assemblies 326 and 328 that may be formed in substantially the same manner as any of the rope assemblies 20, 120, and/or 220 described above. The details of construction and assembly of the rope assemblies 326 and 328 will thus not be again described herein beyond that extent necessary for a complete understanding of the operation of the example rope system 320 and optional sling system 324 formed thereby. During normal use, the rope system 320 extends between two attachment points such as the attachment points 26 and 28 described above.

The first and second rope assemblies 326 and 238 comprise first and second lines 330 and 332, respectively, formed in two separate endless loops and a plurality of organizers 334. The example lines 330 and 332 of the example rope system 320 may be formed of one or more of the following materials: polyester, polyolefin, polyamide (PA), polyethylene terephthalate/polyethersulfone (PET/PES), polypropylene (PP), polyethylene (PE), high modulus polyethylene (HMPE), liquid crystal polymer (LCP), Para-Aramid, poly p-phenylene-2,6-benzobisoxazole (PBO) fibers, high modulus polypropylene (HMPP), and PP/PE blends, but other materials may be used depending on considerations such as characteristics of the lines 330 and 332, the nature of the operating environment, cost, and the like.

The example organizers 334 are arranged at four locations relative to each of the lines 330 and 332. Accordingly, the line system 320 comprises eight of the organizers 334, although only four are visible in the partial view of FIG. 8.

The example first or inner line assembly 326 is slightly shorter than the second or outer line assembly 328. The example line assemblies 326 and 328 are of substantially the same load carrying capacity. Accordingly, the first line assembly 326 may be arranged within and aligned with the second line assembly 328 to double the load carrying capacity of the line system 320 in comparison to either of the line assemblies 326 and 328 alone. However, the line assemblies 326 and 328 may be made to have different load carrying characteristics.

Although the example rope system 320 comprises eight separate organizers 334, at least some (two or more) of these organizers may be combined into a single member or assembly. For example, four separate organizers 334 are depicted in FIG. 8. These four organizers may be configured as two organizers formed by a single member or assembly and two individual organizers, two groups of two organizers formed by two separate members or assemblies, and/or four organizers combined into a single member or assembly. The four organizers (not visible in FIG. 8) on the opposite end of the rope system 320 may similarly be configured as two organizers formed by a single member or assembly and two individual organizers, two groups of two organizers formed by two separate members or assemblies, and/or four organizers combined into a single member or assembly.

5. Terminology

In this written specification, certain reference characters are used both with a suffix and without a suffix. When a given reference character has been used both with and without a suffix, that given reference character is used without a suffix when referring to that component in general, and the given reference character is used with a suffix to distinguish among multiple similar components in a particular example. In this case, the reference character may be used without a suffix in the specification but will not appear in the drawing without a suffix.

The term "longitudinal" refers to the direction of a reference dimension defined by a dimension of a component that is longer than the dimensions of that component in the two directions orthogonal to the reference direction.

The term "parallel" will be used herein to refer to localized longitudinal directions of two components being compared and does not indicate that the two component are parallel along their entire length.

The term "cross" will be used with reference to a particular perspective to refer to one component overlapping or extending over another component.

The terms "over" and "under" will be used to refer to one component being between the viewer and another component from a particular perspective, with the closest component to the viewer being "over" and the farthest from the viewer being "under".

The terms "opposing" or "opposed" are used to refer to portions of an endless loop that are substantially equally spaced from each other in either direction along the endless loop.

What is claimed is:

1. A rope assembly adapted to extend between first and second attachment points, comprising:

a line arranged to define a plurality of loops and first, second, third, and fourth loop portions;

first and second pairs of organizers configured to engage the line such that when the line extends between the first and second attachment points line segments of the line within second and fourth loop portions defined by the line between the at least one pair of organizers engage the first and second attachment points, respectively, and are maintained in a substantially parallel relationship with each other when in contact with the first and second attachment points; and at least one line segments of the line within the first and third loop portions defined by the line between the first and second pairs of organizers cross another line segment within the first and third loop portions.

2. A rope assembly as recited in claim 1, in which the line segments of the line between the pair of organizers define an eye that engages the first attachment point.

3. A rope assembly as recited in claim 1, in which the desired relationship facilitates transfer of loads from the first attachment point to the rope assembly.

4. A rope assembly as recited in claim 1, in which the at least one pair of organizers engages the line such that the line segments of the line between the at least one pair of organizers are maintained in a substantially parallel arrangement.

5. A rope assembly as recited in claim 1, in which:

the rope assembly comprises first and second pairs of organizers; and line segments between the first pair of organizers define a first eye that engages the first attachment point; and line segments between the second pair of organizers define a second eye that engages the second attachment point.

6. A rope assembly as recited in claim 5, in which the line segments of the line between the first and second pairs of organizers define first and second eyes that engages the first and second attachment points, respectively.

7. A rope assembly as recited in claim 5, in which the desired relationship facilitates transfer of loads from the first and second attachment points to the rope assembly.

8. A rope assembly as recited in claim 5, in which the first and second pairs of organizers engage the line such that the line segments of the line between the first and second pairs of organizers are maintained in a substantially parallel arrangement.

9. A rope assembly as recited in claim 1, in which the at least one pair of organizers engages the line such that the line segments of the line between the at least one pair of organizers define at least one segment bundle of more than two segments, where one of the segments in the bundle crosses at least two of the other segments in the segment bundle.

10. A rope assembly as recited in claim 1, in which the at least one pair of organizers engages the line such that the line segments of the line between the at least one pair of organizers define at least one segment bundle of more than two segments, where one of the segments in the bundle extends around at least two of the other segments in the segment bundle.

11. A rope assembly as recited in claim 1, in which the at least one pair of organizers engages the line such that the line segments of the line between the at least one pair of organizers define at least one segment bundle of more than two segments, where one of the segments in the bundle extends between two of the other segments in the segment bundle.

12. A rope assembly as recited in claim 1, in which the at least one pair of organizers engages the line such that:

line segments of the line between the at least one pair of organizers define at least one segment pair of two segments, where the segments in the segment pair cross; and line segments of the line between the at least one pair of organizers define at least one segment bundle of more than two segments.

13. A rope assembly as recited in claim 12, in which the line defines a splice region, where the splice region is located in the at least one segment bundle.

14. A rope assembly as recited in claim 12, in which the line defines a splice region, where the splice region is located outside the at least one segment bundle.

15. A rope assembly as recited in claim 1, in which:

the rope assembly comprises first and second pairs of organizers; and line segments between the first pair of organizers define at least one segment pair of two segments, and at least one segment bundle of more than two segments line segments between the second pair of organizers define at least one segment pair of two segments.

16. A rope assembly as recited in claim 1, in which:

the rope assembly comprises first and second pairs of organizers; and line segments between the first pair of organizers define two segment pairs of two segments, and at least one segment bundle of more than two segments line segments between the second pair of organizers define three segment pairs of two segments.

17. A rope assembly adapted to extend between first and second attachment points, comprising:

a line arranged to define a plurality of loops;

at least one pair of organizers configured to engage the line such that line segments of the line between the at least one pair of organizers are maintained in a desired relationship with each other, and the desired relationship facilitates transfer of loads through the rope assembly between the first and second attachment points; wherein the at least one pair of organizers engages the line such that the line segments of the line between the at least one pair of organizers define at least one segment bundle of more than two segments, where one of the segments in the bundle crosses at least two of the other segments in the segment bundle.

18. A rope assembly adapted to extend between first and second attachment points, comprising:

a line arranged to define a plurality of loops;

at least one pair of organizers configured to engage the line such that line segments of the line between the at least one pair of organizers are maintained in a desired relationship with each other, and the desired relationship facilitates transfer of loads through the rope assembly between the first and second attachment points; wherein the at least one pair of organizers engages the line such that the line segments of the line between the at least one pair of organizers define at least one segment bundle of more than two segments, where one of the segments in the bundle extends around at least two of the other segments in the segment bundle.

19. A rope assembly adapted to extend between first and second attachment points, comprising:

a line arranged to define a plurality of loops;

at least one pair of organizers configured to engage the line such that line segments of the line between the at least one pair of organizers are maintained in a desired relationship with each other, and the desired relationship facilitates transfer of loads through the rope assembly between the first and second attachment points; wherein the at least one pair of organizers engages the line such that the line segments of the line between the at least one pair of organizers define at least one segment bundle of more than two segments, where one of the segments in the bundle extends between two of the other segments in the segment bundle.

20. A rope assembly adapted to extend between first and second attachment points, comprising:

a line arranged to define a plurality of loops;

at least one pair of organizers configured to engage the line such that line segments of the line between the at least one pair of organizers are maintained in a desired relationship with each other, and the desired relationship facilitates transfer of loads through the rope assembly between the first and second attachment points; wherein the at least one pair of organizers engages the line such that line segments of the line between the at least one pair of organizers define at least one segment pair of two segments, where the segments in the segment pair cross; and line segments of the line between the at least one pair of organizers define at least one segment bundle of more than two segments.

21. A rope assembly as recited in claim 20, in which the line defines a splice region, where the splice region is located in the at least one segment bundle.

22. A rope assembly as recited in claim 20, in which the line defines a splice region, where the splice region is located outside the at least one segment bundle.

23. A rope assembly adapted to extend between first and second attachment points, comprising:

a line arranged to define a plurality of loops;

at least one pair of organizers configured to engage the line such that line segments of the line between the at least one pair of organizers are maintained in a desired relationship with each other, and the desired relationship facilitates transfer of loads through the rope assembly between the first and second attachment points; wherein the rope assembly comprises first and second pairs of organizers; and line segments between the first pair of organizers define two segment pairs of two segments, and at least one segment bundle of more than two segments line segments between the second pair of organizers define three segment pairs of two segments.

* * * * *